US006077021A

United States Patent [19]

Roman

[11] Patent Number: 6,077,021

[45] **Date of Patent: *Jun. 20, 2000**

[54] BAG SPLITTER FOR GARBAGE BAGS FILLED WITH STACKED PAPER AND METHOD FOR SPLITTING SUCH FILLED GARBAGE BAGS

[76] Inventor: Walter C. Roman, 475 Thackeray Ave., Worthington, Ohio 43085

[ * ] Notice: This patent is subject to a terminal disclaimer.

[21] Appl. No.: 08/401,720

[22] Filed: Mar. 10, 1995

[51] Int. Cl.[7] ..... B65B 69/00

[52] U.S. Cl. ..... 414/412; 414/786; 83/425.3

[58] Field of Search ..... 414/412, 706; 83/425.3, 946; 241/DIG. 38

[56] References Cited

U.S. PATENT DOCUMENTS

| | | | |
|---|---|---|---|
| 1,896,766 | 2/1933 | Brown | 83/425.3 X |
| 4,067,506 | 1/1978 | Cerroni | 241/DIG. 38 X |
| 5,101,977 | 4/1992 | Roman | 209/3 |
| 5,219,064 | 6/1993 | Roman | 198/836.1 |
| 5,267,823 | 12/1993 | Roman | 414/412 |
| 5,282,713 | 2/1994 | Lande | 414/412 |
| 5,318,399 | 6/1994 | Maron | 414/412 |
| 5,368,432 | 11/1994 | Schoenhard | 414/412 |
| 5,484,238 | 1/1996 | Bielagus | 414/412 |
| 5,484,247 | 1/1996 | Clark et al. | 414/412 |

FOREIGN PATENT DOCUMENTS

| | | | |
|---|---|---|---|
| 5-92145 | 4/1993 | Japan | 241/DIG. 38 |
| 6-170268 | 6/1994 | Japan | 241/DIG. 38 |
| 878668 | 11/1981 | U.S.S.R. | 414/412 |
| 1284896 | 1/1987 | U.S.S.R. | 414/412 |

*Primary Examiner*—Stephen T. Gordon
*Attorney, Agent, or Firm*—Mueller and Smith, LPA

[57] ABSTRACT

The present invention broadly is directed to enhancements to various bag splitting apparatuses. One such improvement for splitting open garbage bags containing stacked paper includes a row of pivotally-mounted blades mounted for rotation away from the filled bags and having a serrated lower edge with downwardly-projecting teeth that confront the bags being conveyed through said assembly, followed by a row of pivotally-mounted blades mounted for rotation away from the bags and having a serrated lower edge with teeth projecting into and confronting the bags being conveyed through the assembly. The corresponding method for splitting open bags containing stacked paper forms another aspect of the present invention.

9 Claims, 1 Drawing Sheet

FIG. 1
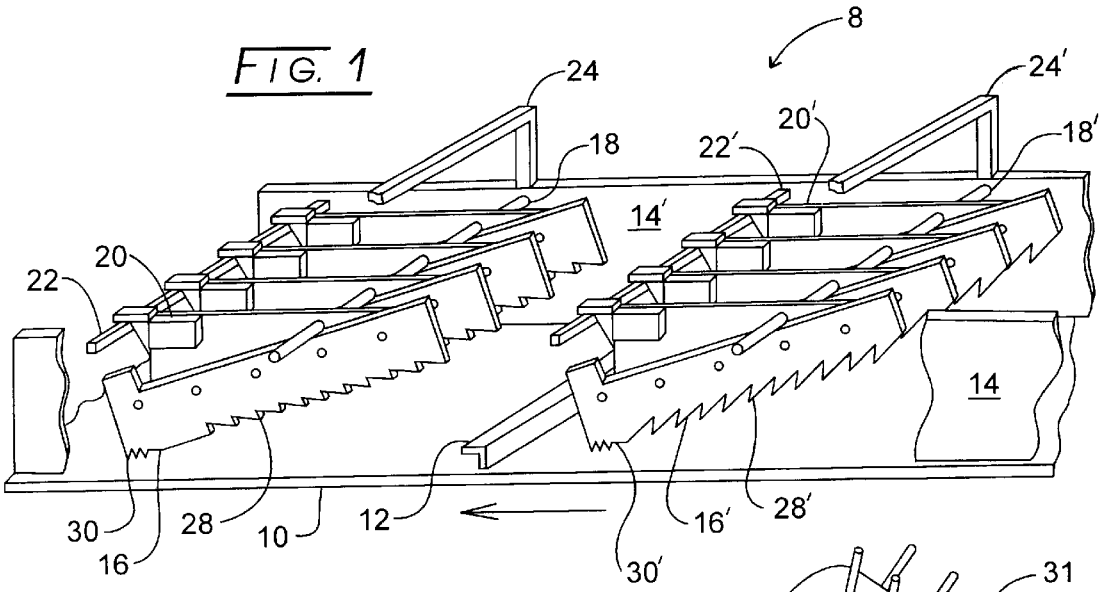
FIG. 2A
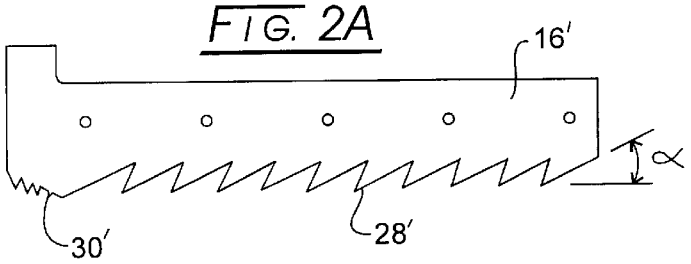
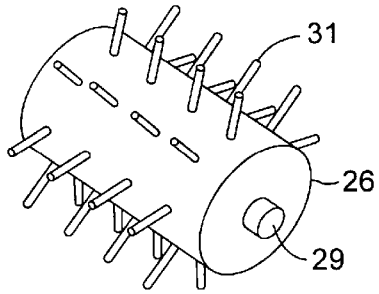
FIG. 3
FIG. 2B
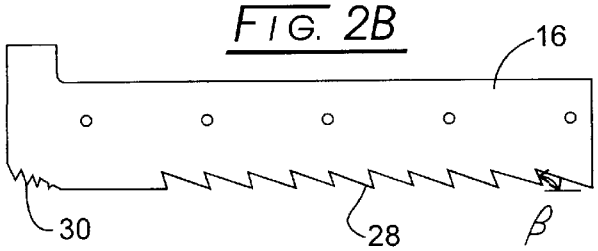
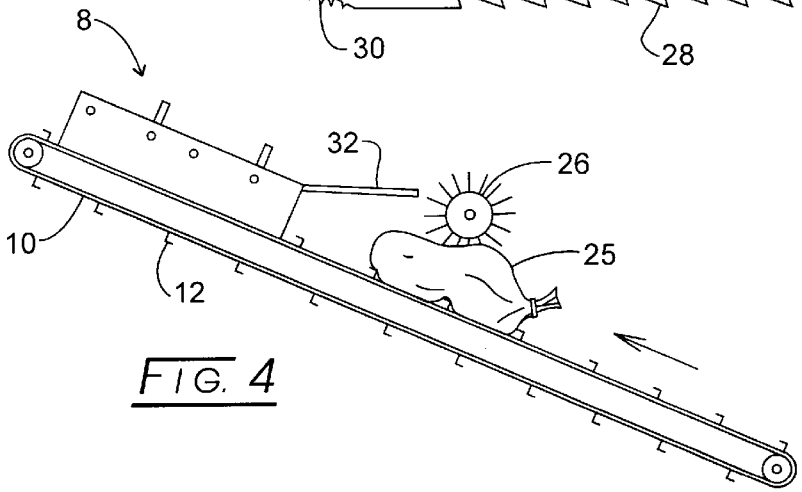
FIG. 4

BAG SPLITTER FOR GARBAGE BAGS FILLED WITH STACKED PAPER AND METHOD FOR SPLITTING SUCH FILLED GARBAGE BAGS

BACKGROUND OF THE INVENTION

The present invention relates to front-end separation of municipal solid waste (MSW) and more particularly to an improved assembly for splitting open bags bearing stacked paper.

Solid waste materials of the type typified by municipal solid waste traditionally have presented problems of disposal. These disposal difficulties have become increasingly critical as populations have expanded and as the per capita production of solid waste has increased. In addition to using waste as a source of fuel or compost, industrial and home refuse or municipal solid waste (MSW) typically comprises several components or fractions which are worth reclaiming. In particular, glass, ferrous and non-ferrous metals, plastic, and paper components are sufficiently valuable to justify their separation from composite MSW. Conventionally, such solid waste has been disposed of by incineration and/or landfill. With the present concern over problems associated with the protection of the environment and because of scarcity of landfill space and governmental regulations, both of these traditional techniques of disposal have become undesirable. Further, separation systems, to remain efficient, must be capable of having a reasonably high throughput rate for the material processed and since MSW varies from one area to the next, and between collections, the separation system also must be capable of handling materials which vary widely in nature and composition. To the present, the throughput rates of conventional systems have not been adequately high enough to derive efficiencies permitting the use of equipment in municipalities of small or medium size. However, because of the ever-increasing rigid requirements for carrying out waste treatment and because of the increasing scarcity of landfill space, some technique must be found to effectively increase such output rates.

To achieve the efficient separation of more valuable fractions of MSW and to derive an environmentally-safe, marketable compost or refuse derived fuel product, a waste treatment process should be carried out wherein raw MSW is passed through a variety of reduction, separation, and related treatment stages. These stages serve to remove inorganic components such as metals, glass, and plastics from the organic component of the MSW. The segregated or separated by-product materials, such as ferrous and non-ferrous metals, glass, and plastic, increasingly are becoming valuable resources worthy of the expenditure of capital for effective separation equipment. Of course, the quality and resultant value of the organic material also is dependent upon the corresponding quality of separation, the presence of plastics, glass, or other foreign particles being undesirable or unacceptable for most commercial applications.

A broad variety of separation techniques have been known to industry. Among those, both manual and automatic techniques have been used. The manual technique that generally involves human pickers usually is not cost effective nor desirable. The automatic techniques which rely on the fraction size for sorting by a grizzly or the magnetic characteristics of the fraction or the density of the fraction for air separation have generally not been employed by industry in such a manner as to eliminate the extensive need of human pickers to further separate MSW into the various fractions where air separation techniques have been applied to municipal waste separation. Designers have found that achieving high quality separation within reasonable cost limits proves to be an elusive goal. Since municipal waste varies widely in geographical, as well as daily, make-up and consistency, a uniform product is not available for separation treatment. Therefore, any separation system involving the sorting of solid waste must be capable of handling a wide variation of waste components.

An improved bag splitting assembly is disclosed in commonly-assigned U.S. Pat. No. 5,267,823. This assembly finds good use in the solid waste sorting system disclosed in commonly-assigned U.S. Pat. No. 5,101,977. A preferred conveyor system for use in both the bag splitting assembly and the solid waste sorting system is disclosed in commonly-assigned U.S. Pat. No. 5,219,064. The disclosure of these patents is expressly incorporated herein by reference.

BROAD STATEMENT OF THE INVENTION

The present invention broadly is directed to enhancements to various bag splitting apparatuses, such as that disclosed in the '823 patent. Thus, the present invention improves an assembly for splitting open contents-filled garbage bags, such as those contained in MSW, and those garbage bags containing grass/lawn material and curbside recycle material.

One such improvement for splitting open garbage bags containing stacked paper comprises a row of pivotally-mounted blades mounted for rotation away from said filled bags and having a serrated lower edge with downwardly-projecting teeth that confront the bags being conveyed through said assembly, followed by a row of pivotally-mounted blades mounted for rotation away from said bags and having a serrated lower edge with teeth projecting into and confronting the bags being conveyed through said assembly. The corresponding method for splitting open bags containing stacked paper forms another aspect of the present invention.

Another improvement comprises a spiked drum mounted ahead of a bag splitter assembly and spaced above said flighted conveyor for puncturing holes in said filled bags to release any air pressure therein, said drum mounted for rotation only in the direction of said flighted conveyor, and a depression plate interposed between said spiked drum and said knife blades and mounted higher above said flighted conveyor by said spiked drum than by said knife blades for compressing said filled bags as they enter said bag splitter assembly. The corresponding method for puncturing air-inflated contents-filled garbage bags forms another aspect of the present invention.

The advantages and operating improvements in the front-end separation of MSW will be readily apparent to those skilled in the art based on this disclosure.

BRIEF DESCRIPTION OF THE DRAWINGS

FIG. 1 is a partial, cross-sectional view of the bag splitting assembly for bags filled with stacked paper, FIGS. 2A and 2B show the negative rake angle of the blade teeth of the first set of blades that confront the staked paper-filled bags and the positive rake angle of the blade teeth of the second set of blades that confront the stacked paper-filled bags, respectively;

FIG. 3 is a perspective view of the non-reversing spiked barrel shown at FIG. 3.

FIG. 4 is a simplified elevational view of the present invention depicting the non-reversing spiked barrel and depression plate, spoked array, and vertical bar screen assembly and highly inclined conveyor assembly; and The drawings will be described in detail below.

DETAILED DESCRIPTION OF THE INVENTION

Conventional blade-type bag splitters, such as that bag splitter disclosed in the '823 patent, tend to cause the stacked paper in plastic garbage bags to bunch up; thus, causing the blades to be lifted upward and the stacked paper to exit the bag splitter in its stacked form still in the plastic bags. Such stacked paper bundles are preclusive to good front-end separation schemes.

Looking initially to the improved bag splitting assembly for splitting open garbage bags containing stacked paper, reference is made to FIG. 1 wherein the bag splitter generally is shown by numeral 8. Bag splitter assembly 8 is seen to house two sets of serrated blades 16 and 16', though the number of blades across the width of bag splitter 8 can be different in number from that shown at FIG. 1. In order to successfully open the stacked paper-filled bags, however, blades 16' are seen to have a serrated lower edge with downwardly-projecting teeth 28' that confront the bags being conveyed through the assembly on conveyor 10 by flights 12 at a negative rake angle, $\alpha$, as shown at FIG. 2A. Such negative rake angle $\alpha$ of teeth 28' on blade 16' with respect to the filled bags means that the teeth slant away from the filled bags and effect a scoring of the bags to expose the stacked paper. For present purposes, "rake angle" is measured from the vertical with a negative rake angle being a negative degree angle and a positive rake angle being a positive angle with respect to the vertical.

The second row of pivotally-mounted blades 16 also have a serrated lower edge, however, such serrated edge has teeth 28 projecting into and confronting the bags being conveyed through assembly 8 at a positive rake angle, $\beta$, such as shown at FIG. 2B. Such positive rake angle $\beta$ of teeth 28 on blade 16 with respect to the scored filled bags urges the stacked paper from within the bags for their separation therefrom. Accordingly, such unique arrangement of teeth on the pivotally-mounted blades has been determined to be effective in ripping open the bags containing stacked paper and urging the stacked paper from within the bags.

The remainder of the construction of bag splitting assembly 8 is like that shown in the bag splitter in the commonly-assigned '823 patent. Thus, blades 16 and 16' are pivotally mounted about transversely-mounted rods 18 and 18' between sidewalls 14 and 14'. Blades 16 and 16' at the opposite side to their pivotal mount rest upon blade rest bars 22 and 22', respectively. The degree of pivoting about bars 18 and 18' is restricted by stock bars 24 and 24', respectively. It should be noted that if the weight of blades 16 and 16' is insufficient, weights 20 and 20' can be added thereto in a variety of positions on the blades, the blades can be biasedly-mounted via springs or other biasing means in order to control the degree of force required to cause blades 16 and 16' to pivot about pivot bars 18 and 18', respectively.

The trailing edges of blade 16' contains grippers 30' that also perform a scoring function aiding in exposing the stacked paper within the plastic bags fed to bag splitting assembly 8. The trailing edges of blade 16 contains grippers 30 are designed to grip and retain the garbage bags themselves and similar items as the material spills onto conveyor 10 and is conveyed through and out of bag splitter 8; thus, effecting a separation of the ruptured garbage bags and their stacked paper contents. Should large hard objects being presented to blades 16 and 16', they will pivot about bar 18 and 18' to avoid damaging bag splitter 8 components. Finally, bag splitter 8 can be inclined upwardly, downwardly, or horizontally in the direction of movement of the conveyor 10. A simple, yet reliable bag splitter, thus, is shown at FIG. 1 for separating stacked paper from within garbage bags.

Since many filled garbage bags also will be filled with trapped air, it would be handy to have the bags punctured to release the air. Also, it would be desirable to compress larger bags down to a uniform size to pass through the inventive bag splitter, the bag splitter shown in the '823 patent, or virtually any other bag splitter. For this reason, provision is made at FIGS. 3 and 4 for spiked barrel 26 to precede bag splitter assembly 8. As can be seen at FIGS. 3 and 4, spiked drum 26 is a generally cylindrical drum having a series of projections or "spikes" 31 emanating therefrom in radial fashion. Drum 26 rotates about shaft 29 in the same direction as conveyor 10 moves; although, drum 26 is non-reversing, that is, it only rotates in one direction. Spikes 31 penetrate through large, billowy garbage bags, like bag 25, to release entrapped air. The punctured bags also are easier to open in the bag splitting operation to release their stacked paper contents. Depression plate 32 follows spiked drum 26 and can be used to mount drum 26 and further forces the garbage bags down by urging trapped air to be expelled from the inside of the garbage bags and to generally compress the bags down to a uniform size for passing through bag splitter assembly 8 or another bag splitter assembly.

While the spiked barrel and depression plate aspect of the present invention has decided merit when used in combination with the present inventive bag splitter or the bag splitter of the '823 patent, such combination certainly can be used with other bag splitters. Other conventional bag splitters make use of swinging blades, augers, discs, and a variety of other means to split open the filled bags for removing the contents from the bags.

Other modifications and changes can be made to the invention disclosed herein in accordance with the disclosure and precepts herein and without departing from the spirit of the invention.

I claim:

1. In an assembly for splitting open contents-filled garbage bags containing stacked paper, which assembly includes a flighted conveyor that conveys the filled garbage bags into a confined bag splitter assembly, the improvement which comprises:

(a) a first row of pivotally-mounted blades positioned against a first rest bar and bearing a first blade weight positioned to further bias said first row blades against said first rest bar, said first row blades mounted for rotation away from said filled bags and having a serrated lower edge with projecting teeth that confront the bags being conveyed through said assembly at a negative rake angle for scoring of said bags, followed by (b) a second row of pivotally-mounted blades positioned against a second rest bar and bearing a second blade weight positioned to further bias said second row blades agiainst said second rest bar, said second row blades mounted for rotation away from said scored bags and having a serrated lower edge with projecting teeth that confront the scored bags from the first row blades being conveyed through said assembly at a positive rake angle for opening of the scored bags and urging the paper from said bags.

2. The assembly of claim 1, wherein said serrated edges of both rows of blades are inclined with respect to the conveyor.

3. The assembly of claim 1, wherein at least some of said second row blades have a bottom edge which bottom edge has a serrated segment for gripping bags scored by said first row of blades to separate contents therefrom.

4. The assembly of claim 3, wherein said second row blade lower edges have a leading and a trailing lower edge portion, and the trailing bottom edge portion has said gripping serrated segments.

5. The assembly of claim 1, wherein the rotation of each of said blades about its pivotal mount is limited by a stop.

6. The assembly of claim 1, wherein said convevor is inclined upwardly from the horizontal in the direction of its movement and the bag splitter assembly also is inclined upwardly from the horizontal in the direction of movement of the conveyor.

7. In a method for splitting open contents-filled garbage bags containing stacked paper, wherein filled garbage bags are conveyed by a flighted conveyor into a confined bag splitter assembly, the improvement which comprises the steps of:

(a) providing said bag splitter assembly with a first row of pivotally-mounted blades positioned against a first rest bar and bearings a first blade weight positioned to further bias said first row blades against said first rest bar, said first row blades mounted for rotation away from said filled bags and having a serrated lower edge with projecting teeth that confront the bags being conveyed through said assembly at a negative rake angle for their scoring, followed by (b) providing said bag splitter assembly additionally with a second row of pivotally-mounted blades positioned against a second rest bar and bearing a second blade weight positioned to further bias said second row blades against said second rest bar, said second row blades mounted for rotation away from said scored bags and having a serrated lower edge with projecting teeth that confront the scored bags from the first row of blades being conveyed through said assembly at a positive rake angle for opening of the scored bags and urging the paper from said bags.

8. The method of claim 7, wherein said second row blade lower edges are provided with a leading and a trailing lower edge portion, and the trailing lower edge portion has a gripping serrated segment.

9. The method of claim 7, which further includes the step of inclining the bag splitter assembly upwardly from the horizontal in the direction of movement of the conveyor.

* * * * *